US005303633A

United States Patent [19]

Guthrie et al.

[11] Patent Number: 5,303,633

[45] Date of Patent: Apr. 19, 1994

[54] SHOCK COMPRESSION JET GUN

[75] Inventors: Michael J. Guthrie, Huntsville, Ala.; Thomas C. Powell, Tullahoma, Tenn.; Loren G. Mooney, Huntsville, Ala.

[73] Assignee: Teledyne Industries, Inc., Los Angeles, Calif.

[21] Appl. No.: 409

[22] Filed: Jan. 4, 1993

Related U.S. Application Data

[62] Division of Ser. No. 482,498, Feb. 21, 1990, Pat. No. 5,194,690.

[51] Int. Cl.[5] ..... F41A 1/04

[52] U.S. Cl. ..... 89/8; 89/7; 102/440

[58] Field of Search ..... 89/7, 8; 102/465, 466, 102/467, 440

[56] References Cited

U.S. PATENT DOCUMENTS

| | | | |
|---|---|---|---|
| 392,922 | 11/1888 | Johnson et al. | 102/443 |
| 1,940,657 | 12/1933 | Woodford | 102/465 |
| 2,048,267 | 7/1936 | Keith | 102/465 |
| 2,075,325 | 3/1937 | Wyman | 102/465 |
| 2,587,243 | 2/1952 | Sweetman | 102/307 |
| 2,787,958 | 4/1957 | Brandt | 102/476 |
| 2,797,892 | 7/1957 | Ryan | 102/307 |
| 2,995,987 | 8/1961 | Fitzpatrick | 89/7 |
| 3,024,595 | 3/1962 | Helvenston et al. | 149/1 |
| 3,157,124 | 11/1964 | Muller | 102/476 |
| 3,186,304 | 6/1965 | Biehl | 102/306 |
| 3,188,855 | 6/1965 | Brown | 102/306 |
| 3,204,527 | 9/1965 | Godfrey et al. | 89/8 |
| 3,311,020 | 3/1965 | Piacesi et al. | 89/8 |
| 3,465,638 | 8/1967 | Canning | 89/8 |
| 3,470,040 | 9/1969 | Tarpley | 149/1 |
| 3,744,427 | 7/1973 | Good et al. | 102/385 |
| 3,763,740 | 10/1973 | Fletcher et al. | 89/8 |
| 3,786,755 | 1/1974 | Eckstein et al. | 102/467 |
| 4,126,078 | 11/1978 | Ashley | 89/7 |
| 4,132,149 | 1/1979 | Ashley | 89/1.705 |
| 4,160,413 | 7/1979 | Rudgeway | 102/306 |
| 4,342,261 | 8/1982 | Majerus | 102/307 |
| 4,493,264 | 1/1985 | Jameson | 102/476 |
| 4,574,681 | 3/1986 | Gundrum et al. | 89/7 |
| 4,658,699 | 4/1987 | Dahm | 89/8 |
| 4,664,631 | 5/1987 | Pederson et al. | 89/7 |
| 4,711,154 | 12/1987 | Chryssomallis | 102/440 |
| 4,852,459 | 8/1989 | Bulman | 102/440 |
| 4,895,062 | 1/1990 | Chryssomallis et al. | 102/440 |
| 4,913,029 | 4/1990 | Tidman et al. | 89/8 |
| 4,957,035 | 9/1990 | Eskam et al. | 89/8 |
| 5,072,647 | 12/1991 | Goldstein et al. | 89/8 |

OTHER PUBLICATIONS

Alex B. Wenzel, "A Review of Explosive Accelerations for Hypervelocity Impact," Int. J. Impact Engng vol. 6, pp. 681–692, 1987.

A. C. Charters, "Development of the High-Velocity Gas-Dynamics Gun," Int. J. Impact Engng vol. 5, pp. 181–203, 1987.

Astron Research and Engineering, "The Wave Gun," Feb. 1987.

Wilfred E. Baker, "Explosions in Air," University of Texas Press, Austin and London, pp. 31–40, 118–121, 150–163.

*Primary Examiner*—David H. Brown

*Attorney, Agent, or Firm*—Beveridge, DeGrandi, Weilacher & Young

[57] ABSTRACT

A shock compression jet gun with associated explosive charge assembly. The shock compression jet gun features a breech for storage of the explosive charge assembly, a projectile tube, and an expansion nozzle disposed between the breech and projectile tube. The expansion nozzle includes converging and diverging passageways. The explosive charge assembly includes a shock absorbing outer casing, a detonator, a shaped charged positioned within the casing and a compressible medium retained within a recess formed in the shaped charge. The compressible medium is maintained within the recess by way of a membrane sealing one end of the casing. In a preferred embodiment the compressible medium is a liquid such as ammonia, water or a mixture of liquid ammonia and water which dissociate(s) into a mixture of light gases upon detonation of the shaped charge.

26 Claims, 3 Drawing Sheets

SHOCK COMPRESSION JET GUN

This is a divisional of co-pending application Ser. No. 07/482,498 filed Feb. 21, 1990 which is now U.S. Pat. No. 5,194,690

BACKGROUND OF THE INVENTION

1. Field of the Invention

This invention relates to high velocity projectile launchers or guns as well as an explosive charge assembly specifically suited therefor. In particular, the present invention relates to a gun which utilizes an explosive charge assembly which utilizes low molecular weight gas or plasma to drive a projectile.

2. Description of the Related Art

Since about the 14th century, the term "gun" has commonly been used to represent a device which includes a long tube open at one end, the muzzle, and, closed at the other end, the breach. The projectile to be fired is placed part way down the tube from the breech, leaving a volume, the chamber, which holds the propellant. After ignition, the propellant combusts rapidly filling the chamber with propellant gas at high pressure and temperature. This released energy created by the ignition of the propellant is used to accelerate both the gas created by the detonation of the propellant and the projectile. In spite of improvements being made in propellants and materials for forming the muzzle and breech, the utilization of the products of the deflagration or detonation as the propelling gas has led to a limit on muzzle velocity (e.g., 1.4~1.8 km/sec) which is inadequate for many desired uses.

The realization that inherent high sound speed in light gases (especially, high temperature light gases) could lead to higher launch velocities led to the development of "light gas guns" such as that disclosed in U.S. Pat. No. 3,186,304. A light gas gun uses a low-molecular weight gas such as hydrogen which is compressed to high pressures and temperatures for use as a driver gas to accelerate projectiles to high velocities. Single and two-stage light gas guns capable of accelerating small projectiles to velocities in excess of 10 km/sec were developed in the late 1960's. The light gas gun technique centers around converting a substantial portion of the chemical energy from an explosive charge into the internal energy of a light gas. Strong shocks generated by the collapse of a light gas containment tube or by compression of a conventional piston produce high energy densities in light gases and lead to the increase in projectile velocities.

A single stage light gas gun utilizing a thin walled metal containment cylinder surrounded by a chemical explosive is illustrated in U.S. Pat. No. 3,465,638. Upon detonation, the thin wall of the containment cylinder accelerates inward forming a conical "piston" that compresses the gas.

A two stage light gas gun is disclosed in U.S. Pat. No. 3,311,020 and operates in a manner similar to that of the single stage light gas gun except for the use of a conventional piston as the means to compress the low molecular weight gas.

A modified form of the light gas gun, commonly referred to as a wavegun, is disclosed in U.S. Pat. No. 4,658,699. The wavegun involves an initial detonation which causes a piston and shock wave to move forward compressing a light gas. The placement of a diaphragm at the end of the light gas chamber results in a deflection of the piston and a compression of the still-burning propellant. This process continues through several compressions and deflections with the number of cycles depending on the strength of the diaphragm and the type of propellant. By multiple compressions, higher temperatures and pressures are achieved than in the standard two-stage light gas gun. An advantage of the wavegun is that it allows a smaller pump tube and lighter piston than the standard two-stage light gas gun.

Despite the increase in projectile velocity obtainable by the various light gas guns, the use of these devices is restricted due to the light gas guns typically having pump tubes 10 to 20 meters in length and pistons typically weighing between 1 to 8 kg. These structural attributes of the standard light gas guns make them inappropriate for many uses such as use as a field weapon. In addition, although light gas guns can accelerate projectiles (about 5 kg) to velocities of 5 km/sec, they are difficult to mechanize and are limited to slow rates of fire.

The wavegun has overcome some of these problems with a pump tube that is typically less than 1 meter long and a piston mass of less than 1 kg, but is felt not to be capable of achieving 3 km/sec with a 1.4 kg. projectile.

A problem common to both the two-stage light gas gun and the wavegun is the inefficiency of having to drive a fairly massive piston to achieve compression of the light gas. Similarly, the problems presented by the single stage light gas gun such as U.S. Pat. No. 3,186,304 include the problem of achieving a suitable gas temperature and pressure within the gun that provides both high velocity projectiles as well as adaptability for use in the field.

SUMMARY OF THE INVENTION

An object of the present invention is to avoid the problems associated with the prior art two-stage light gas gun and wavegun by avoiding the use of the extra mass associated with a piston. The elimination of a piston makes the present invention inherently more efficient than the two-stage light gas gun and the wavegun. Furthermore, the use of an expansion nozzle further enhances the efficiency of the present invention by converting more of the internal energy of the propelling gas or plasma into kinetic energy. Hence, high projectile velocity is achievable for guns well suited for use in the field. Moreover, the concepts of the present invention are also applicable in providing an improved laboratory gun. These advantages of the present invention are made more evident in the following discussion.

One aspect of the invention concerns the development of an improved explosive charge assembly adapted to be inserted into a recess formed in a gun's breech assembly. The explosive charge assembly comprises an outer casing preferably formed of shock absorbing material such as high-density plastic foam or honeycomb sandwich. Covering one end of the casing is a detonator and covering the other end is a membrane or diaphragm preferably formed of a plastic or metal material such as polyurethane or aluminum. Adjacent to the detonator and extending within the casing and towards the end covered by the membrane is a shaped charge.

In a preferred embodiment, the shaped charge is cylindrical in shape with a conical recess formed therein which diverges in a direction away from the detonator. The recess is filled with a compressible medium which either represents a light gas, a mixture of light gases, a liquid, or a mixture of liquids which ideally dissociate into a light gas mix or plasma upon detonation of the shaped charge. The dissociated light gas mix preferably has a low average molecular weight. For example, liquid ammonia, which dissociates into a mixture of hydrogen and nitrogen with an average molecular weight of 8.5, is representative of a suitable material. When such a liquid is used, the energy released upon detonation of the charge goes into dissociating the liquid, raising the internal energy of the resulting products and accelerating the gas.

In one embodiment of the present invention an expansion nozzle is integral or secured to the casing at the end where the membrane or diaphragm is attached. The nozzle preferably includes a first converging inlet which opens into a diverging outlet such as in a Venturi nozzle. The charge assembly is structured such that when inserted into the breech assembly of a gun the outlet of the nozzle opens either directly or indirectly into the gun's projectile tube or muzzle. The use of an expansion nozzle enhances efficiency by converting some of the internal energy of the propelling gas into kinetic energy causing an increase in acceleration of the propelling gas as the gas flows through the converging-diverging nozzle.

Another aspect of the invention features a shock compression jet gun which is adapted for use with the explosive charge assembly. The shock compression jet gun includes a breech assembly having an internal conduit which frictionally receives the shock absorbing casing of an explosive charge assembly. The internal conduit of the breech assembly also includes a bore for receipt of the expansion nozzle. In one embodiment of the invention the expansion nozzle is threadably received within the bore and separate and distinct from the explosive charge assembly. Alternatively, for those situations where the explosive charge assembly includes an integral expansion nozzle, the bore frictionally receives the expansion nozzle when the entire explosive charge assembly is inserted into the conduit formed in the breech assembly.

The shock compression jet gun further includes a breech block which is preferably of the interrupted screw type for loading the shock compression jet gun from the rear. The breech block includes a firing mechanism for activation of the primer charge or detonator positioned at the rear end of the casing. The shock compression jet gun also features a projectile tube attached to a tube locking sleeve which, in turn, is attached to the front end of the breech assembly. Once the projectile tube is in position, the diverging portion of the nozzle assembly opens into the open, rearward end of the projectile tube.

The projectile to be launched is positioned in the projectile receiving end of the tube forward of the diverging portion of the expansion nozzle and can include an obturating band, sabot and/or shock absorbing layers.

The shock compression jet gun can further include a recoil mechanism cradle which is structured so as to allow the breech assembly, tube locking sleeve and projectile tube to slide axially therein. To assist in the axial sliding of the breech assembly, the recoil mechanism cradle includes rollers which contact the exterior of the breech assembly.

In a further embodiment, a slide support slidable upon a gun cradle is provided. The slide support provides support to the gun tube with the latter being releasable or fixedly secured to a locking sleeve. The locking sleeve is releasably secured to the breech assembly such that, when the locking sleeve is released from attachment with the breech assembly, the gun tube, locking sleeve and slide support are free to slide away from the breech assembly along the guide means formed in the cradle. This arrangement is particularly suited for the situation where the expansion nozzle is threadably or integrally received by the breech assembly as, once the slide support, locking sleeve and gun tube are slid forward, a projectile can be easily positioned in place.

In operation, the explosive charge assembly is inserted into the conduit formed in the breech assembly. The firing mechanism is triggered resulting in detonation of the primer and, eventually, the shaped charge. As the shaped charge detonates in the usual propagating wave fashion, the compressible liquid medium (when such is used) vaporizes or dissociates into a light gas or plasma. Upon reaching a predetermined pressure, the resulting driver medium or previously present light gas breaks through the membrane or diaphragm and accelerates out of the casing of the explosive charge assembly and out through the expansion nozzle. The driver medium, light gas or light gases then cause the projectile to move along and out of the projectile tube at a high velocity (e.g., 3–5 km/sec for 1–6 kg projectiles).

The shock compression jet gun of the present invention thus offers the simplicity of conventional gun technology but with much improved performance. Further, the ease of assembly of the shock compression jet gun and the high projectile velocity achieved by the shock compression jet gun provides for easy application in both the field of weaponry and high velocity projectile impact studies such as those involving simulated meteor impact research.

BRIEF DESCRIPTION OF THE DRAWINGS

The present invention will be more fully understood from the detailed description given hereinbelow and the accompanying drawings which are given by way of illustration only, and thus are not limitative of the present invention, and wherein:

FIGS. 2D and 2E show still another embodiment of the invention.

DETAILED DESCRIPTION OF THE PREFERRED EMBODIMENTS

Figure 1:
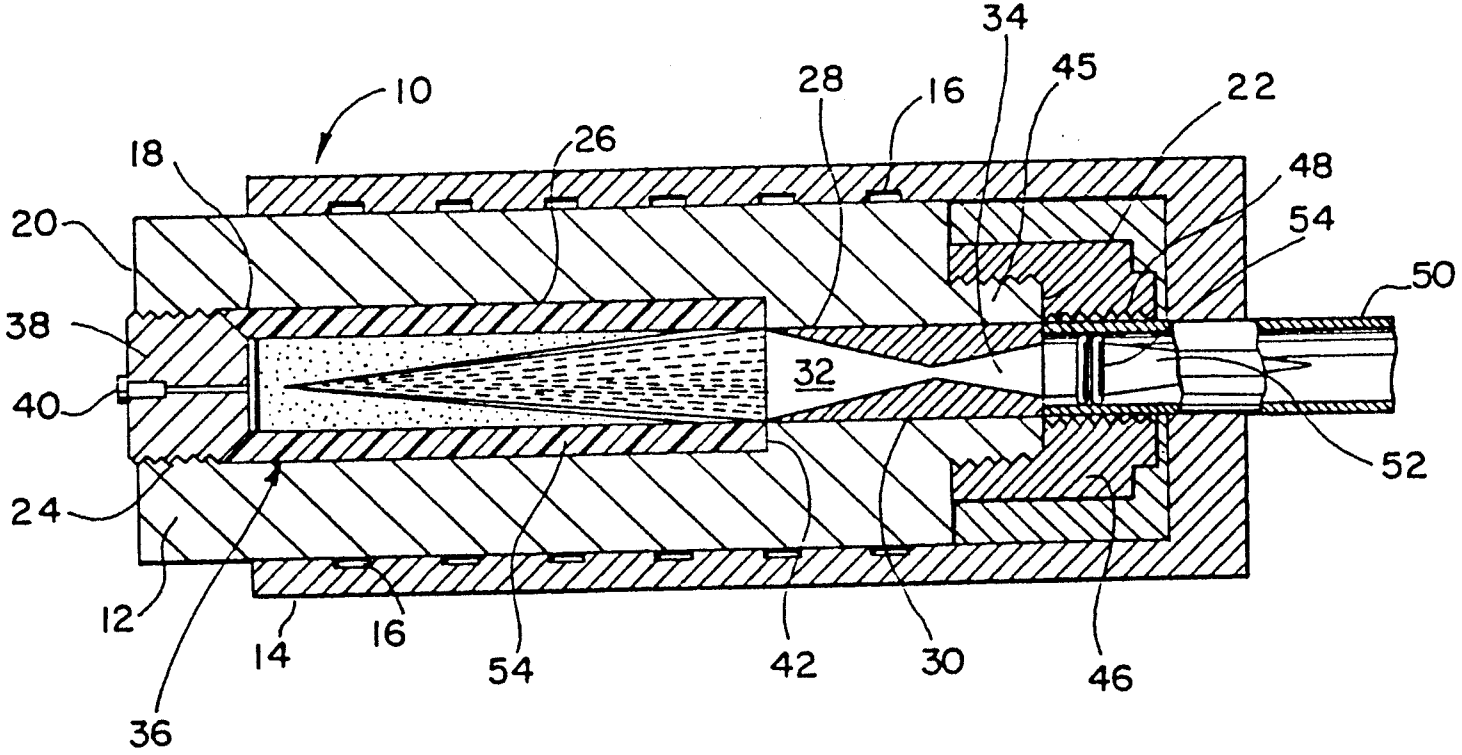
FIG. 1 shows a partially cut-away cross-sectional elevational view of a preferred embodiment of the shock compression jet gun with the explosive charge assembly in position.

FIG. 1 shows in cross-sectional elevational view shock compression jet gun 10 which includes breech assembly 12 nestled within recoil mechanism cradle 14 on rollers 16. The breech assembly is preferably formed of a steel alloy which is poured and hot-forged. Breech assembly 12 has formed therein an axial conduit 18 which extends from rear end 20 to front end 22.

Conduit 18 formed in breech block assembly 12 features three sections which comprise first section 24, second section 26 and third section 28. Third section 28 of conduit 18 preferably features an internally threaded wall within which expansion nozzle 30 is threadably secured. Expansion nozzle 30 includes a converging section 32 and a diverging section 34. Suitable material of which the expansion nozzle 30 may be formed include a high temperature, high pressure composite material or, alternatively, a refractory alloy. Expansion nozzle 30 is illustrated as extending the entire length of third conduit section 28 from the opening in front end 22 of breech assembly 12 to the location where third conduit section 28 opens into second conduit section 26.

Second conduit section 26 is shown formed of a greater cross-sectional periphery than that of third conduit section 28. Second conduit section 26 is adapted to receive in sliding fashion explosive charge assembly 36 shown both in FIGS. 1 and 2. Explosive charge assembly 36, once in position, is shown to extend essentially the entire length of second conduit section 26. Second conduit section opens into first conduit section 24 which includes a threaded internal wall adapted to receive and secure in place breech block 38. Breech block 38 is preferably formed of a steel alloy that is poured and hot-forged. Block 38 is also preferably of the interrupted screw type which allows for loading of gun 10 from the rear and includes firing mechanism 40. Once secured, breech block 38 has a forward end in contact with explosive charge assembly 36 such that explosive charge assembly 36 is fired axially between that forward end and shoulder 42 formed at the junction of second and third conduit sections 26, 28. Firing mechanism 40 extends axially through breech block 28 such that its forward end is in contact with detonator or primer 44 (FIG. 2) forming part of explosive charge assembly 36.

Forward end 22 of breech assembly 12 includes threaded protrusion 45 for receiving, in locking fashion, tube locking sleeve 46 which may be formed of the same material as breech assembly 12. Locking sleeve 46 includes axially extending, threaded recess 48 for receipt of the threaded end of projectile tube 50. The central axis of threaded recess 48 is commensurate with the central axis of expansion nozzle 30 such that diverging section 34 of expansion nozzle 30 opens either directly or indirectly into the rear opening of projectile tube 50. An aperture is formed in recoil cradle mechanism 14 through which projectile tube 50 extends. A ring of suitable bearing material (not shown) may also be provided to lessen the friction between projectile tube 50 and the surface defining the aperture formed in recoil cradle mechanism 14.

Projectile 52 is positioned at the aft end of tube 50 and may include an obturating band 54 to maintain a sealed relationship between projectile 52 and the interior of tube 50. The rear end of projectile 50 also preferably includes a shock absorbing device (not shown).

Figure 2A:
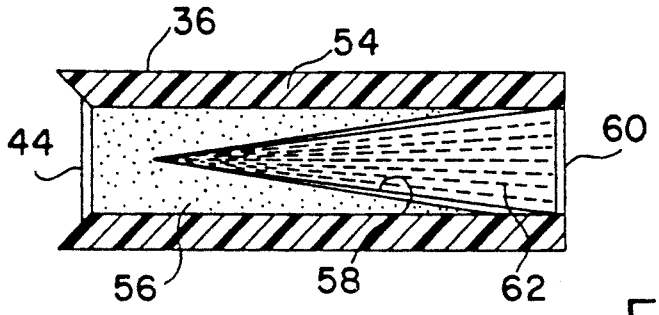
FIG. 2A shows in cross-sectional elevational view the explosive charge assembly shown in FIG. 1.
Figure 2B:
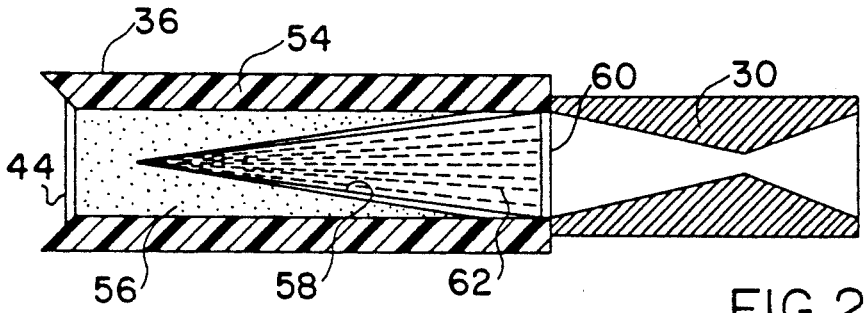
FIG. 2B shows an alternate embodiment of the invention.

In an alternate embodiment of the invention, shown in FIG. 2B. expansion nozzle 30 is integral or securely attached to casing 54 and thus forms part of explosive charge assembly 36. With this arrangement, third section 28 of conduit 18 formed in breech assembly 12 does not include threads such that the entire explosive charge assembly (including nozzle 30) may be slidably inserted. This arrangement allows for projectile 52 to be loaded from the rear of breech assembly 12 prior to insertion of explosive charge assembly 36 and thus avoids the requirement of unlocking tube 50 for insertion of projectile 52.

Figure 2C:
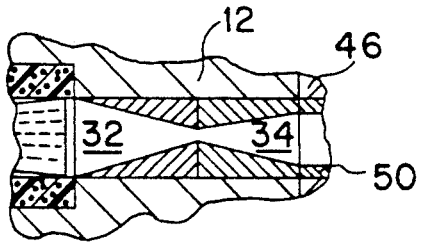
FIG. 2C shows an alternate embodiment of the invention.

In a further embodiment, shown in FIG. 2C rather than utilizing an insertable nozzle having a convergent conduit and a divergent conduit, a convergent conduit can be formed in the breech block assembly and an entirely divergent, removable conduit can be positioned forward of the convergent conduit.

FIG. 2A illustrates in cross-sectional view the embodiment of explosive charge assembly 36 which does not include an integrally attached expansion nozzle. Explosive charge assembly 36 includes outer casing 54 which is preferably formed of a shock absorbing material such as high-density plastic foam or honeycomb sandwich as depicted in FIGS. 2C and 2E. Positioned at the aft end of casing 54 is detonator 44 and extending forwardly away from detonator 44 is shaped explosive charge 56. Shaped charge 56 is made of PETN, RDX, Tetryl, TNT or some other mixture or combination. Shaped charge 56 is preferably formed so as to have a conical recess 58 which has its tip lying on the central axis of casing 54 within the interior of shaped charge 56. In a preferred embodiment the tip of recess 58 originates at a distance away from the detonator equal to about 1/10 of the entire length of shaped charge 56. The base of recess 58 and the forward most end of shaped charge 56 are commensurate with the forward edge of casing 54. Moreover, membrane 60 is secured to the forward end of casing 54 so as to seal oft recess 58. Membrane 60 is preferably formed of plastic or aluminum with a thickness of about a few millimeters thickness to a centimeter in thickness so as to rupture when pressure within the casing reaches about 10,000 ATM.

It is also preferable to position a plastic or metallic liner to separate the shaped charge from the compressible medium 62 stored within recess 58. Such a liner would prevent any premature reaction between the charge material and the compressible medium. From a safety standpoint, even with the use of such a liner, it is preferable to choose a charge material and compressible medium which do not violently react when placed in contact. The membrane or diaphragm 60 can be made as a part of the containment liner mentioned above which is used to separate the charge and the compressible medium or it can be a separate component or part of the outer charge casing. Compressible medium 62 can be a light gas in its stored state or a material which totally dissociates upon detonation of shaped charge 56 into a mixture of light gases or at least partially dissociates into a mixture of gas and liquid so as to form a driving medium.

Hydrogen would be the ideal compressible medium or propelling gas since its low molecular weight gives the highest muzzle velocity for a given stagnation temperature. However, in the present invention, the use of hydrogen as compressible medium 62 is less preferred than the mediums discussed below due to difficulties in fitting enough hydrogen into a breech of practical size. A more preferred alternative is found in the utilization of a liquid compressible medium which dissociates into gas having average molecular weights preferably below 18. Ammonia is one such preferred medium as it readily dissociates upon detonation of shaped charge 56 into a mixture of hydrogen and nitrogen with an average molecular weight of about 8.5. That is, two molecules of $NH_3$ will dissociate into one $N_2$ molecule and three $H_2$ molecules with the molecular weight of the former being about 28 and the latter about 6 giving a total of 34 which, when divided by the number of molecules 4 gives an average molecular weight of 8.5. Ammonia has a boiling point at 1 atmosphere pressure of about −33° Celsius and therefore for storage within the recessed shape charge the ammonia must be maintained at a pressure of about 25 ATM. The sealing membrane therefore must be securely attached to the casing such as by welding or strong adhesives.

Water represents another preferred choice for the compressible medium as it dissociates into a mixture of hydrogen and oxygen with an average molecular weight of 12.

The invention also contemplates the use of mixed gases for the compressible medium such as a mixture of hydrogen with helium or some other inert gas such as argon.

Furthermore, a mixture of water and ammonia is also contemplated with the proportion of each varying to the contemplated use. Such a mixture would significantly reduce the storage pressure required to contain the liquid mixture.

The use of various other shaped charges, although not as preferred as the use of that which is shown in FIGS. 1 and 2, is also contemplated. Again, a compressible medium suitable for dissociation into light gases would be retained within the recess by way of a rupturable membrane.

In achieving velocities of 3–5 km/s for 1–6 kg projectiles, a relatively large but manageable charge is required. A strong detonation can produce extremely high pressure on the surrounding breech walls and thus the breech walls must be designed to withstand such impacts. In the present invention, casing 54 is formed of a shock absorbing material such as high-density plastic foam or honeycomb sandwich to assist in reducing the impact on the surrounding breech walls. FIGS. 2D and 2E illustrate casing 54 with FIG. 2D schematically illustrating the honeycomb casing 54 and FIG. 2E showing a representative, schematic honeycomb cross-section for casing 54.

In the embodiment shown in FIG. 1 projectile tube 50 has an internal diameter of about 30 mm as does the external diameter of the expansion nozzle. The throat of the nozzle is approximately 6 mm in diameter. Explosive charge assembly 36 has an external diameter of about 120 mm and an axial length of about 260 mm. Also, shaped charge 56 has a diameter of about 112 mm and the thickness of casing 54 is about 4 mm. Shaped charge 56 preferably has a detonation yield within the range of about 5 to 6 MJ/Kg. This requires that breech assembly 12, when formed of forged steel, have a wall thickness of about 20 cm. Further, the volume of recess 58 formed in shaped charge is preferably about 2000 $cm^3$. A suitable length for projectile tube 50 shown in FIG. 1 is about 5 to 6 meters while the axial length of breech assembly 12, from rear end 20 to front end 22, is about 70 cm.

The above-noted dimensions are those suitable for a 30-mm gun. Of course, such dimensions can be scaled to other tube diameters or modified to take into account variations in structural materials as well as variations in shape and detonation yield of the charge relied upon.

Figure 4:
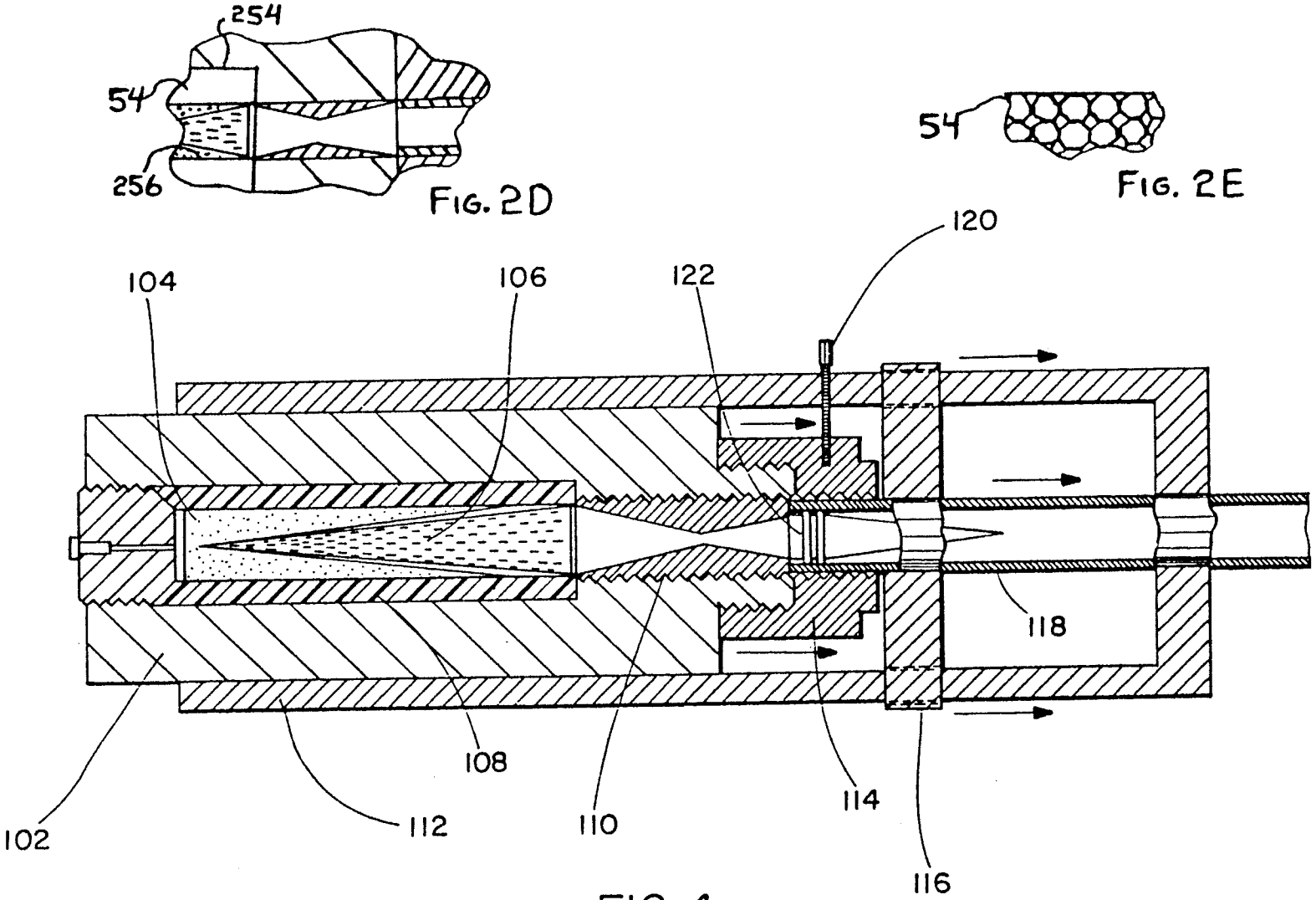
FIG. 4 shows a partially cut-away cross-sectional elevational view of another preferred embodiment of the shock compression jet gun with the explosive charge assembly in position.

FIG. 4 shows another preferred embodiment of the shock compression jet gun which provides for easy reloading. As shown in FIG. 4, the jet gun includes breech block 100, breech assembly 102, high explosive charge assembly 104, compressible medium 106, and shock absorbing casing 108 all of which are similar in structure to the embodiments previously described. The embodiment of FIG. 4 also includes a cradle 112 which includes mounting means for slidably receiving slide support 116. Both slide support 116 and cradle 112 include a recess for receipt of projectile tube 118. The projectile tube has one of its ends received within locking sleeve 114 which is releasably fixed to one end of breech assembly 102.

With the arrangement of FIG. 4 the loading of explosive charge assembly 104 and projectile 122 is simplified so as to allow for quick and easy reloading. For example, a gun such as that shown in FIG. 4 can demonstrate 1 round every 6 seconds.

Loading is preferably achieved as follows:

(a) Locking sleeve 114 is manually disengaged from breech assembly 102 by rotating lever 120 until the interrupted screw design of sleeve 114 allows for disengagement;

(b) Locking sleeve 114, slide support 116, and projectile tube 118 are slid forward along cradle 112 to allow a projectile 122 to be loaded manually or mechanically;

(c) Breech block 100 is removed, the breech is swabbed and charge assembly 104 is loaded manually or mechanically; and (d) Both the breech block 100 locking sleeve are re-engaged to their respective engagement points on breech assembly 102.

In operation, projectile 52 is loaded by unlocking tube 50 from tube locking sleeve 46 and inserting projectile 52 into the aft end of tube 50 or in the manner described immediately above for the fourth embodiment. Alternatively, for the situation where explosive charge assembly 36 includes expansion nozzle 30, projectile 52 is inserted from the rear of breech assembly 12 into the aft end of tube 50 without unlocking tube 50. In the latter situation, casing 54 and expansion nozzle 36 would need to be made of a high strength material such as composite or refractory alloys to prevent nozzle 30 from being blown through tube 50.

Explosive charge assembly 36 is then detonated by activating firing mechanism 40 and detonator 44. The energy released from shaped charge 56 goes into disassociating the liquid stored in recess 58, raising the internal energy of the resulting products of disassociation or of the preexisting light gas or gases, and accelerating the resultant driving medium out through the ruptured membrane. The driving medium is then further accelerated as it travels through expansion nozzle 30.

As the propellant gas begins to emerge from the expansion nozzle exit, a normal shock forms behind projectile 52. As the projectile 52 begins to move, this shock is replaced by a train of oblique shock and expansion waves. The shocks decelerate the gas emerging from expansion nozzle 30 and the gas already present in the aft portion of tube 50, while the expansion waves accelerate the gas just behind projectile 52.

Figure 3:
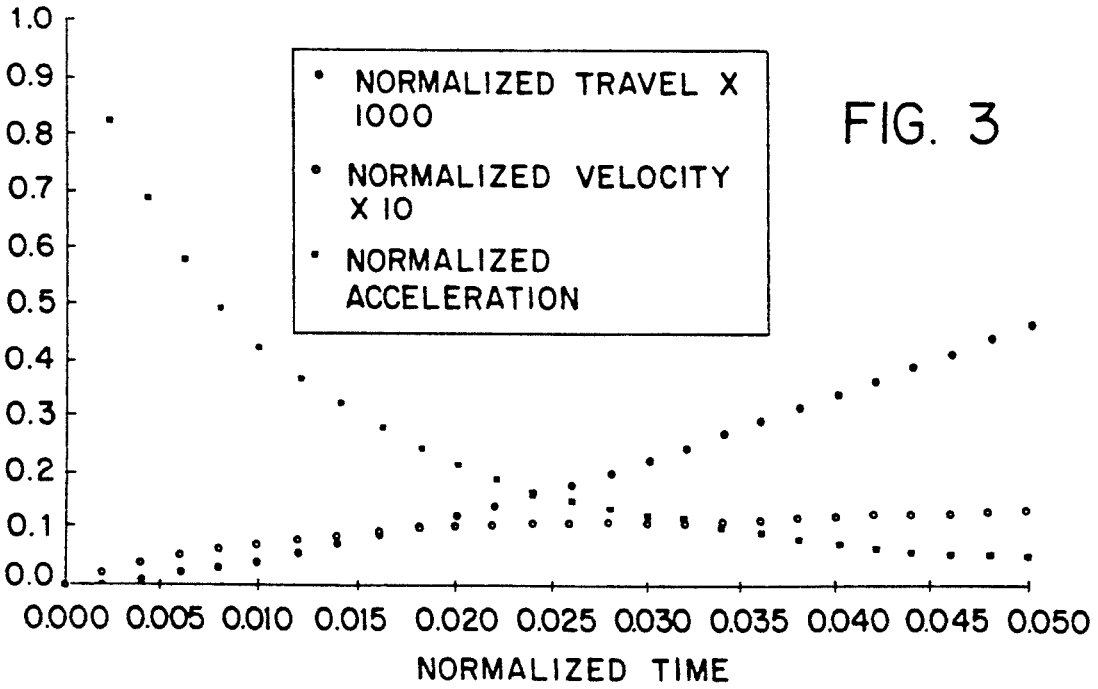
FIG. 3 shows a graph depicting numerically computed values for normalized projectile travel, velocity, and accelerations as functions of normalized time.

The flow in expansion nozzle 30 and tube 52 and the expectant motion of the projectile have been computed numerically with the results depicted in FIG. 3. There is shown in FIG. 3 normalized projectile travel, velocity, and acceleration as functions of normalized time. In determining points on the graph of FIG. 3 the specific heat ratio of the propellant gas was taken to be 1.3 and the ratio of the mass of the projectile to the mass of the propellant gas is taken to be 1. Of course, variations in these assumptions would result in different behavior characteristics . It is noted from the graph that the projectiles velocity increases very little after a normalized time of 0.04 seconds.

The projectile's maximum acceleration is given by $$A_M = A_N\left(\frac{T_N}{B_L}\right)\left(\frac{V_M}{V_N}\right)^2\left(\frac{1}{M_P}\right)$$

where $A_M$—maximum projectile acceleration m/s$^2$ $A_M$—normalized accelerations at the muzzle $T_N$—normalized projectile travel $B_L$—barrel length m $V_M$—muzzle velocity m/s $V_N$—normalized projectile velocity $M_P$—normalized projectile mass Suppose, for example, the normalized time at the muzzle is taken to be 0.02; then $T_N=1.195\times10^{-4}$, $V_N=0.009560$, and $A_N=0.2135$. For a barrel length of 6 m and a muzzle velocity of 4 km/sec, the projectile's maximum acceleration, $A_M$, is 75,950 g, which is acceptable for high-performance projectiles.

The foregoing illustrates that the present invention provides a gun which achieves high projectile velocities and yet is simplistic in structure and readily adaptable for repeated use.

Although the preferred embodiments of the present invention have been described with reference to the accompanying drawings, many modifications and changes may be affected by those skilled in the art without departing from the scope and spirit of the invention as appended hereinafter.

What is claimed is:

1. A shock compression jet gun, comprising:

a breech assembly having an internal conduit formed therein, with said conduit having a rearward end and a forward end, and said conduit including a first chamber adapted for receipt of an explosive charge assembly and a second chamber positioned forward of said first chamber;

a projectile tube attached to said breech assembly;

an expansion nozzle positioned within said second chamber forward of said first chamber, said expansion nozzle including a converging internal passageway and a diverging internal passageway, said converging internal passageway positioned rearwardly of said diverging internal passageway and opening into said diverging passageway and said diverging passageway positioned rearwardly of said projectile tube and opening into said projectile tube.

2. A shock compression jet gun as recited in claim 1, further comprising a projectile tube and a tube locking sleeve, said tube locking sleeve including means for locking said locking sleeve to said breech assembly and said locking sleeve further including means for securing said projectile tube to said locking sleeve in a manner which positions the axial center line of said projectile tube in alignment with the axial center line of said expansion nozzle.

3. A shock compression jet gun as recited in claim 1, further comprising a recoil mechanism cradle surrounding said breech assembly, and said cradle including rollers which allow for axial movement of said breech assembly within said cradle.

4. A shock compression jet gun as recited in claim 1, wherein said expansion nozzle has a Venturi shape.

5. A shock compression jet gun as recited in claim 1, wherein the converging internal passageway of said expansion nozzle is conical in shape.

6. A shock compression jet gun as recited in claim 1, further comprising a breach block threadably received within said conduit and adapted to maintain an explosive charge assembly in position within said first conduit.

7. A shock compression jet gun as recited in claim 6, further comprising a firing mechanism extending through said breech block.

8. A shock compression jet gun as recited in claim 1, wherein said expansion nozzle is formed of composite materials.

9. A shock compression jet gun as recited in claim 8, wherein the diverging internal passageway of said expansion nozzle is conical in shape.

10. A shock compression jet gun as recited in claim 1, further comprising an explosive charge assembly which includes a casing adapted to be slidably received within said first chamber, a shaped explosive charge retained within said casing, a compressible medium stored within a recess formed in said shaped explosive charge, and a retaining membrane attached to said casing and adapted to maintain said compressible medium within the recess formed in said shaped charge prior to detonation of said shaped charge.

11. A shock compression jet gun as recited in claim 10, wherein said compressible medium is adapted to dissociate into light gases which have an average molecular weight less than or equal to about 18.

12. A shock compression jet gun as recited in claim 10, wherein said compressible medium is liquid ammonia.

13. A shock compression jet gun as recited in claim 10, wherein said compressible medium is water.

14. A shock compression jet gun as recited in claim 10, wherein the recess formed in said shaped explosive charge is conical in shape.

15. A shock compression jet gun as recited in claim 10, wherein said casing is formed of a shock absorbing material of high density plastic foam or a honeycomb sandwich.

16. A shock compression jet gun as recited in claim 10, wherein said expansion nozzle is threadably received within said second conduit and the converging internal passageway of said expansion nozzle has a rearward end which, when said casing is slidably received within said internal conduit, is essentially commensurate with the retaining membrane attached to said casing.

17. A shock compression jet gun as recited in claim 10, wherein said explosive charge assembly further comprises detonation means positioned rearwardly of said shaped explosive charge.

18. A gun, comprising:

a cradle support with guide means formed therein;

a slide support slidably received by said guide means;

a projectile tube extending through a recess formed in said slide support and positioned so as to be supported by said slide support;

a breach assembly including a recess for receipt of a charge; and a nozzle positioned forward of said breech assembly recess;

a locking sleeve member secured to one end of said projectile tube, said locking sleeve releasably secured to said breech assembly forward of said nozzle, and said slide support, projectile tube and locking sleeve being dimensioned and arranged such that said slide support, projectile tube and locking sleeve can be slid forward of said breech assembly upon said guide means when said locking sleeve is released from securement with said breech assembly.

19. A gun as recited in claim 18, wherein said nozzle includes a divergent conduit positioned forward of a convergent conduit.

20. A gun as recited in claim 18, wherein said nozzle is formed of composite materials.

21. A gun as recited in claim 18, wherein said nozzle is formed of refractory alloys.

22. A shock compression jet gun, comprising:

a breech assembly having an internal conduit formed therein, with said conduit having a rearward end and a forward end, and said conduit including a first chamber adapted for receipt of an explosive charge assembly;

a projectile tube attached to said breech assembly; and a casing in contact with said first chamber, said casing being formed of a shock absorbing or cushioning material and said casing being structured and arranged specifically for a shock absorbing function whereby the casing is compressible and resilient so as to appreciably assist in reducing impact of an exploding charge on said breech assembly.

23. A shock compression jet gun as recited in claim 22 wherein said shock absorbing material is a high-density plastic foam.

24. A shock compression jet gun as recited in claim 22 wherein said shock absorbing material includes a honeycomb layer of resilient material.

25. A shock compression jet gun as recited in claim 22 wherein said casing surrounds a shaped explosive charge with a recess formed therein, and said recess containing a compressible medium which dissociates into a driven gas upon explosion of said shaped charge.

26. A shock compression jet gun, comprising:

a breech assembly having an internal conduit formed therein, with said conduit having a rearward end and a forward end, and said conduit including a first chamber adapted for receipt of an explosive charge assembly;

a projectile tube attached to said breech assembly; and a casing in contact with said first chamber, said casing being formed of a shock absorbing material which is compressible and resilient so as to assist in reducing impact of an exploding charge on said breech assembly, and wherein said casing surrounds a shaped explosive charge with a recess formed therein, and said recess containing a compressible medium which dissociates into a driven gas upon explosion of said shaped charge.

* * * * *